US007720323B2

(12) United States Patent
Yamate et al.

(10) Patent No.: US 7,720,323 B2
(45) Date of Patent: May 18, 2010

(54) HIGH-TEMPERATURE DOWNHOLE DEVICES

(75) Inventors: Tsutomu Yamate, Yokohama (JP); Soon Seong Chee, Kokubunji (JP); Stephane Vannuffelen, Hampshire (GB); Colin A. Wilson, Tolworth (GB); Juei Igarashi, Yokohama (JP); Khalid Ouaaba, Sagamihara (JP); Koichi Naito, Machida (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 10 days.

(21) Appl. No.: 12/239,822

(22) Filed: Sep. 29, 2008

(65) Prior Publication Data

US 2009/0038794 A1 Feb. 12, 2009

Related U.S. Application Data

(63) Continuation-in-part of application No. 11/017,264, filed on Dec. 20, 2004, now Pat. No. 7,515,774, and a continuation-in-part of application No. 11/023,956, filed on Dec. 28, 2004, now abandoned, and a continuation-in-part of application No. 11/532,904, filed on Sep. 19, 2006.

(51) Int. Cl.
*G02B 6/00* (2006.01)
*G01V 3/00* (2006.01)
*E21B 41/02* (2006.01)

(52) U.S. Cl. ..... 385/12; 340/853.1; 166/244.1

(58) Field of Classification Search ..... 385/12; 340/853.1; 166/244.1
See application file for complete search history.

(56) References Cited

U.S. PATENT DOCUMENTS

| | | | | |
|---|---|---|---|---|
| 5,119,679 | A | 6/1992 | Frisch | |
| 5,394,492 | A * | 2/1995 | Hwang | 385/33 |
| 5,778,114 | A * | 7/1998 | Eslambolchi et al. | 385/12 |
| 6,249,627 | B1 * | 6/2001 | Bond et al. | 385/49 |
| 6,813,403 | B2 * | 11/2004 | Tennyson | 385/12 |
| 6,933,491 | B2 * | 8/2005 | Maida, Jr. | 250/227.14 |
| 7,638,761 | B2 | 12/2009 | Csutak | |
| 2002/0131734 | A1 * | 9/2002 | Stark | 385/100 |
| 2003/0052258 | A1 * | 3/2003 | Russell et al. | 250/227.17 |
| 2004/0258377 | A1 * | 12/2004 | Berkey et al. | 385/123 |
| 2005/0100307 | A1 * | 5/2005 | Desmone | 385/147 |
| 2007/0062696 | A1 | 3/2007 | Wilson et al. | |
| 2007/0110355 | A1 * | 5/2007 | Jaaskelainen et al. | 385/12 |

OTHER PUBLICATIONS

Z.Chen, D.Schlenker, T.Miyamoto, T.Kondo, M.Kawaguchi, F.Koyama and K.Iga, "High Temperature Characteristics of Nearly 1.2 um GaInAs/GaAs/AlGaAs Lasers", Jpn.J.Appl. Phys. vol. 38 (1999) pp. L 1178-L 1179.

(Continued)

*Primary Examiner*—Frank G Font
*Assistant Examiner*—Jerry Blevins
(74) *Attorney, Agent, or Firm*—Matthias Abrell; Jody DeStefanis; Jeff Griffin

(57) ABSTRACT

Subterranean oilfield high-temperature devices configured or designed to facilitate downhole monitoring and high data transmission rates with laser diodes that are configured for operation downhole, within a borehole, at temperatures in excess of 115 degrees centigrade without active cooling.

21 Claims, 16 Drawing Sheets

OTHER PUBLICATIONS

Fujitsu, University of Tokyo Develop World's First 10Gbps Quantum Dot Laser Featuring Breakthrough Temperature-Independent Output, http://www.fujitsu.com/global/news/pr/archives/month/2004/20040910-01.html.

G.Williams. et al., Distributed temperature sensing (DTS) to characterize the performance of producing oil wells, Proceedings of SPIE vol. 4202 (2000), p. 39-p. 53.

Paroscientific, Inc. http://www.paroscientific.com/fiberoptapp.htm, (2007).

Eric Udd, "Fiber Optics Smart Structures and Skins II", Proceedings, SPIE—The International Society for Optical Engineering, (1989).

* cited by examiner

HIGH-TEMPERATURE DOWNHOLE DEVICES

RELATED APPLICATIONS

This is a continuation-in-part of U.S. patent application Ser. No. 11/017,264, filed 20 Dec. 2004, and entitled "Methods and Apparatus for Single Fiber Optical Telemetry", and a continuation-in-part of U.S. patent application Ser. No. 11/023,956, filed 28 Dec. 2004, and entitled "Methods and Apparatus for Electro-Optical Hybrid Telemetry", and a continuation-in-part of U.S. patent application Ser. No. 11/532,904, filed 19 Sep. 2006, and entitled "Method and Apparatus for Photonic Power Conversion Downhole", the entire contents of which are incorporated herein by reference.

FIELD

The present disclosure relates generally to downhole systems for gathering data from subterranean formations. More particularly, the present disclosure relates to downhole systems having devices that are configured or designed for high-temperature operations, within a borehole, at temperatures in excess of about 115 degrees centigrade.

BACKGROUND

Logging and monitoring boreholes has been done for many years to enhance and observe recovery of oil and gas deposits. In the logging of boreholes, one method of making measurements underground includes attaching one or more tools to a wireline connected to a surface system. The tools are then lowered into a borehole by the wireline and drawn back to the surface ("logged") through the borehole while taking measurements. The wireline is usually an electrical conducting cable with limited data transmission capability. Similarly, permanent monitoring systems are established with permanent sensors that are also generally attached to an electrical cable.

Demand for higher data transmission rates for wireline logging tools and permanent monitoring systems is growing rapidly because of higher resolution sensors, faster logging speeds, and additional tools available for a single wireline string. Although current electronic telemetry systems have evolved, increasing the data transmission rates from about 500 kbps (kilobits per second) to 2 Mbps (megabits per second) over the last decade, data transmission rates for electronic telemetry systems are lagging behind the capabilities of the higher resolution sensors. In fact, for some combinations of acoustic/imagining tools used with traditional logging tools, the desired data transmission rate is more than 4 Mbps.

In addition, while higher data transmission rates are desirable, many tools in current use would have to be completely reworked or replaced to incorporate new data transmission technologies. It would be desirable to facilitate faster data transmission rates with minimal changes to existing tools and equipment.

Furthermore, oilfield application of fiber optics sensors has been progressing in recent years for monitoring of certain parameters. However, many downhole applications require high temperature operations, and optical devices such as laser diodes degrade rapidly or do not operate properly at high temperatures. Therefore, use of fiber optics for communication between surface systems and downhole tools, as well as use of downhole sensors, in high-temperature conditions, within a borehole, has been limited.

SUMMARY

The present disclosure addresses the above-described deficiencies and others. Specifically, the present disclosure provides devices for downhole, high-temperature systems and methods that may be particularly useful for subterranean investigation tools.

In one aspect of the present disclosure, a subterranean tool is configured to operate at elevated temperatures downhole in a well traversing a formation. In some aspects herein, the downhole tool includes an optical device configured or designed for downhole use at temperatures in excess of about 115 degrees centigrade; and at least one light source optically connected to the optical device for providing input light to the optical device, wherein the light source comprises one or more laser diode, the laser diode being configured or designed for operation downhole, within a borehole, at temperatures in excess of about 115 degrees centigrade. The applicants realized that the laser devices of the present disclosure are suitable for downhole applications at temperatures in excess of about 115 degrees centigrade without active cooling. However, it is envisioned that active cooling might be desirable in some circumstances, for instance, to extend the operating range of the presently disclosed devices. In this, active cooling may be utilized in circumstances that require efficient, reliable operation of the laser devices at temperatures in excess of about 175 degrees centigrade.

In certain embodiments of the present disclosure, the optical device may comprise a downhole optical telemetry module or cartridge. In other embodiments, the optical device may comprise a downhole optical sensor. In yet other embodiments of the present disclosure, the optical device may comprise a downhole configuration for powering a sensor with one or more high-temperature laser diode connected with, for example, a photovoltaic cell. In yet other embodiments, the optical device may comprise one or more high-temperature laser diode associated with downhole sensing systems such as, for example, a flowmeter, a fluid imager, a spectrometer, an interferometric sensor, among others that are disclosed herein. In further embodiments disclosed herein, the optical device may comprise one or more high-temperature laser diode in combination with one or more photo-sensitive detector configured or designed to provide, for example, an electro-optical isolator circuit, optical connectors for wireless telemetry, intra and inter-tool optical communication, among others that are disclosed herein.

The high-temperature laser diode may be combined with an electrical-to-optical (EO) modulator downhole, within a borehole, to provide a downhole optical telemetry system. In this, the present disclosure envisions that the EO modulator may be electrically connected to the high-temperature laser diode to modulate the high-temperature laser diode, and the modulated optical signal may be inputted to an optical fiber cable. Alternatively, or in addition, the high-temperature laser diode may be optically connected to the EO modulator, such as, for example, a lithium niobate (LiNbO3) modulator, and the modulated optical signal may be inputted to an optical fiber cable.

In further embodiments of the present disclosure, the laser diode may be optically connected to an optical digital sensing system downhole, within a borehole. The laser diode may be configured or designed for downhole use, within a borehole, at temperatures in excess of about 150 degrees centigrade. The laser diode may comprise an edge emitting laser diode having GaInAs—GaAs and/or a vertical cavity surface emitting laser diode (VCSEL) having GaInAs—GaAs. The laser diode may be configured or designed to operate at wavelengths of about 1.0 to about 1.2 μm. The laser diode may be a multi-mode or a single-mode laser diode. In this, it is contemplated that single-mode laser diodes of the present disclosure may be suited for interferometric sensing devices and high rate data telemetry of the type disclosed herein.

In aspects of the present disclosure, an optical fiber may be optically connected with the optical device, wherein the optical fiber comprises at least one of a single-mode optical fiber and a multi-mode optical fiber, the optical fiber transmitting data to and from downhole electronics.

A subterranean system is configured to operate at elevated temperatures, in excess of about 115 degrees centigrade, downhole in a well traversing a formation. The system comprises a downhole tool; and an optical fiber extending between the downhole tool and a surface data acquisition system. In aspects of the present disclosure, the downhole tool comprises a downhole optical telemetry cartridge having at least one electrical-to-optical (EO) modulator and a laser diode light source connected to the EO modulator, wherein the laser diode light source is configured or designed to operate downhole, within a borehole, at temperatures in excess of about 115 degrees centigrade without active cooling, and at wavelengths of about 1.0 to about 1.2 μm. In one embodiment, the EO modulator may be electrically connected with the laser diode to modulate optical signals for input to an optical fiber cable. In another embodiment, the laser diode may be optically connected with the EO modulator and the modulated optical signals may be input to an optical fiber cable.

A fluid analysis system is configured to operate downhole at elevated temperatures in excess of about 115 degrees centigrade in a well traversing a formation. At least a first light source generates input light downhole, within a borehole, across a wide, continuous spectral range; and an optical sensor is optically connected to the first light source and operates by the input light generated by the light source to measure signals of interest and determine properties of formation fluids downhole, within a borehole, wherein the first light source comprises one or more laser diode, the laser diode being configured or designed for operation downhole, within a borehole, at temperatures in excess of about 115 degrees centigrade without active cooling. The downhole optical sensor may be attached to an optical fiber. The downhole optical sensor may comprise a MEMS sensor disposed on a substrate. A second laser diode may be provided for communication uphole, and optically connected to the optical fiber for communicating sensor data uphole. The optical fiber may comprise only one, single-mode optical fiber, the single-mode optical fiber transmitting data to and from downhole sensor electronics.

In aspects of the present disclosure, the downhole optical sensor may be located on a wireline tool. The downhole optical sensor may be a permanent downhole sensor. The system may further include one optical fiber, the one optical fiber transmitting data to and from the wireline tool or the permanent downhole sensor.

A subterranean sensor system is provided, comprising a downhole, long wavelength optical light source; at least one subterranean sensor located downhole; and at least one of a single-mode and a multi-mode fiber optic line coupled to the optical light source and extending to a surface data acquisition system, wherein the optical light source comprises one or more laser diode, the laser diode being configured or designed for operation downhole, within a borehole, at temperatures of at least 115 degrees centigrade without active cooling. In aspects herein, the at least one subterranean sensor may comprise multiple sensors, wherein each downhole sensor is optically coupled to the at least one of a single-mode and multi-mode fiber optic line. The sensor system may further comprise a telemetry system optically coupled to the fiber optic line configured to relay sensor information uphole, and having a laser diode for communication uphole, the laser diode being configured or designed for operation downhole, within a borehole, at temperatures of at least 115 degrees centigrade without active cooling.

Additional advantages and novel features will be set forth in the description which follows or may be learned by those skilled in the art through reading these materials or practicing the invention. The advantages of the invention may be achieved through the means recited in the attached claims.

BRIEF DESCRIPTION OF THE DRAWINGS

The accompanying drawings illustrate embodiments of the present invention and are a part of the specification. Together with the following description, the drawings demonstrate and explain the principles of the present invention.

Figure 1A:
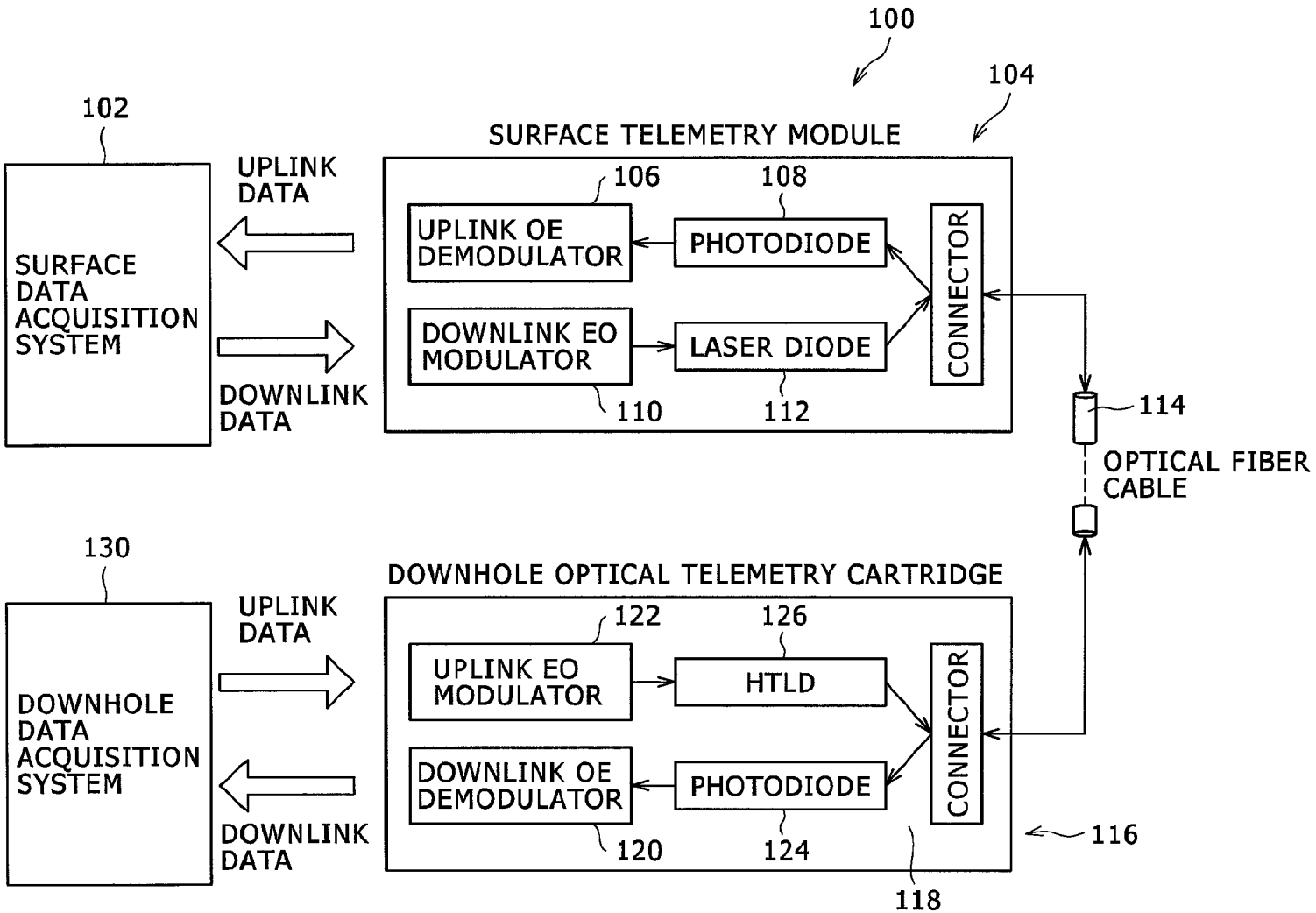
FIG. 1(A) is a schematic depiction of one system with a downhole optical telemetry cartridge according to one embodiment of the present disclosure.

Throughout the drawings, identical reference numbers and descriptions indicate similar, but not necessarily identical elements. While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the scope of the invention as defined by the appended claims.

DETAILED DESCRIPTION

Illustrative embodiments and aspects are described below. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such a development effort might be complex and time-consuming, but would nevertheless be a routine undertaking for those of ordinary skill in the art having the benefit of this disclosure.

Reference throughout the specification to "one embodiment" or "an embodiment" or "some embodiments" means that a particular feature, structure, or characteristic described in connection with the embodiment is included in at least one embodiment of the present disclosure. Thus, the appearance of the phrases "in one embodiment" or "in an embodiment" or "in some embodiments" in various places throughout the specification are not necessarily all referring to the same embodiment. Furthermore, the particular features, structures, or characteristics may be combined in any suitable manner in one or more embodiments.

As used throughout the specification and claims, the term "downhole" refers to a subterranean environment, particularly in a wellbore. "Downhole tool" is used broadly to mean any tool used in a subterranean environment including, but not limited to, a logging tool, an imaging tool, an acoustic tool, a permanent monitoring tool, and a combination tool. A "long" wavelength refers to light wavelengths over 940 nm. "Optical device" is used broadly to mean any device that creates, manipulates, or measures electromagnetic radiation, i.e., a device for producing or controlling light. "High-temperature" refers to downhole temperatures in excess of about 115 degrees centigrade. The words "including" and "having" shall have the same meaning as the word "comprising."

Moreover, inventive aspects lie in less than all features of a single disclosed embodiment. Thus, the claims following the Detailed Description are hereby expressly incorporated into this Detailed Description, with each claim standing on its own as a separate embodiment.

As is generally known, conventional laser diode devices are typically configured or designed to operate at about 85 degrees centigrade. Such conventional devices are not suited for efficient operation, and in some cases are unable to operate, at elevated temperatures, i.e., above 85 degrees centigrade, for example, at temperatures in excess of about 115 degrees centigrade. In this, the inherent low temperature operating range (85 degrees centigrade or less) of known downhole optical devices utilizing such laser diodes restricts the use of these devices in high-temperature downhole applications that require optical components to operate at temperatures in excess of, for example, 115 degrees centigrade and, in some cases, in excess of 150 degrees centigrade.

Typically, in high temperature operations an active cooling device, such as a thermo electric cooler (TEC), is needed for the laser diode to operate. An active cooling device requires additional components for temperature control and power. Additional complexity in the tool architecture reduces reliability. High-temperature laser diode devices of the type disclosed herein simplify tool design and improve the reliability of the downhole tools by eliminating in most instances the need for active cooling of the laser diode devices in high temperature applications.

The inventors of the present application recognized that laser diode technology utilizing, for example, a highly strained GaInAs—GaAs quantum well (QW) structure provides laser diode devices that are capable of operating at high-temperature downhole conditions without active cooling. The inventors herein discovered that optical devices based on such laser diode technology would enable high-temperature downhole applications such as, for example, high-temperature downhole light sources for optical telemetry systems and optical sensing systems. The present inventors further recognized that the optical devices of the present disclosure would provide reliable, efficient results at temperatures above about 85 degrees centigrade, for example, above about 115 degrees centigrade, without active cooling. However, the present disclosure also contemplates cooling the optical devices described herein so as to extend their operating range and efficiency as desirable or necessary.

The present disclosure provides some embodiments directed towards improving, or at least reducing, the effects of one or more of the above-identified problems and others that are known in the art. In one of many possible embodiments, a high-temperature downhole oilfield sensor system is provided. In other possible embodiments, a high-temperature downhole optical telemetry system is provided. The high-temperature downhole oilfield systems comprise a downhole light source, a downhole optical device, and, optionally, an optical fiber extending between the downhole system and a surface data acquisition system, wherein the downhole light source comprises a laser diode configured or designed for high-temperature downhole applications, such as a laser diode suitable for withstanding high-temperature operations of at least 115 degrees centigrade.

The principles described herein contemplate methods and apparatus facilitating optical communications and sensing, with optical sensors or otherwise, using downhole tools and sensors in high temperature applications. The use of fiber optics between downhole tools and the surface provides higher data transmission rates than previously available. The principles described herein facilitate fiber optic sensing and communications between downhole tools and sensors, and associated surface systems, even in high temperature environments. Some of the methods and apparatus described below include systems that are capable of using long wavelength, single mode communications, which reduces dispersion and loss over long distances.

As previously discussed above, demand for higher resolution and faster data transmission for logging tools is growing rapidly. Longer tool combinations, and a demand for better imaging, means that currently available telemetry bandwidth is inadequate. The present disclosure provides enabling technology for high speed telemetry platforms and sensing systems in high-temperature downhole environments. The solutions proposed herein reduce tool and system costs, improve tool reliability by simplifying the telemetry architecture, and provide direct high speed communications to the tool sensors. The tool architecture described herein provide significant expansion capability to existing tool architecture allowing greater functionality and services to be provided by existing tools. In this, as a consequence of the ideas in the present disclosure new tool designs and applications are possible that were not realizable with the presently available telemetry capabilities. For example, a key component for an optical telemetry system is a reliable high speed optical source. The devices disclosed herein provide high speed communications in high-temperature downhole applications without a need for active cooling of the devices.

Another issue recognized by the present inventors and addressed by the present disclosure relates to hydrogen darkening of optical fibers at elevated temperatures. It will be appreciated that such a phenomenon is of particular concern in the high-temperature oilfield applications of the type discussed in the present disclosure. FIG. 7 is a graph showing hydrogen ($H_2$) and —OH absorption into doped silica optical fibers. Commercially available single mode (SM) optical fibers operate on standard laser diode wavelengths of 1.3 μm and 1.55 μm. However, both the aforementioned wavelengths are sensitive to hydrogen darkening. Therefore, hermetic sealing of the optical fiber using specialized coatings is necessary to strengthen the single mode fiber, and to protect it against hydrogen darkening. The specialized coatings are expensive, and add a considerable cost to the telemetry cable. The present inventors have recognized that a laser diode light source that operates at about 1.0 μm to about 1.2 μm significantly reduces the effects of hydrogen darkening. In this, a 1.2 μm laser diode source minimizes the phenomenon known as hydrogen darkening, and the requirement for expensive hermetic sealing of single mode optical fibers.

Aspects disclosed herein include the benefits of fiber optic communication and sensor systems combined with a plurality of devices attached along a coiled tubing, or a cable line, wire line, slickline, or any other suitable downhole deployment means.

Utilization of fiber optic sensor systems provides benefits from many advantages offered by fiber optic systems. For example, fiber optic systems can operate passively and therefore downhole electronics and associated power from the surface to operate the downhole electronics are not required. The ability to eliminate downhole electronics improves reliability of the downhole sensor systems particularly in higher temperature environments. The electronics necessary for operating the sensor arrays can be located at the surface and since the surface electronics can be relatively expensive, they can be shared with other wells and utilized for multiple downhole fiber optic sensor systems. Also, fiber optic technology allows for a smaller profile and lighter weight system. Still further, all of these capabilities are advantageous for acoustic and seismic imaging applications which require a large sensor array with high data transmission capabilities. In this regard, fiber optic sensors can also support multi-fictional measurements through the fiber optic line. This feature has great advantage in wire line or cable line applications as well as production and formation monitoring sensor systems.

For purposes of this disclosure, when any one of the terms wire line, cable line, slickline or coiled tubing or conveyance is used it is understood that any of the above-referenced deployment means, or any other suitable equivalent means, may be used with the present disclosure without departing from the spirit and scope of the present invention.

FIG. 1(A) is a schematic depiction of a downhole optical telemetry system (100) according to principles of the present disclosure. The optical telemetry system (100) includes a surface data acquisition unit (102) in electrical communication with or as a part of a surface telemetry unit (104). The surface telemetry unit (104) may or may not be an optical telemetry module. The surface telemetry unit (104) includes an uplink optical-to-electrical (OE) demodulator (106) with a photo detector or diode (108) that receives optical uplink data and converts it to electrical signals that can be collected by the data acquisition unit (102).

The surface telemetry unit (104) also includes a downlink electrical-to-optical (EO) modulator (110). An optical source (112), for example, a laser diode, is shown with the downlink EO modulator (110). Alternatively, the optical source (112) may be placed downhole in the borehole. The EO modulator (110) may include any available EO modulator. The uplink OE demodulator (106) and the downlink EO modulator (110) are operatively connected to a fiber optic interface (114), for example, a single optic fiber. The fiber optic interface (114) provides a high transmission rate optical communication link between the surface telemetry unit (104) and a downhole optical telemetry cartridge (116). The downhole optical telemetry cartridge (116) is part of the optical telemetry system (100) and includes a downhole electro-optic unit (118). The downhole electro-optic unit (118) includes a downlink OE demodulator (120) and an uplink EO modulator (122). The downlink OE demodulator (120) includes a photo detector or diode (124) that receives optical downlink data and converts it to electrical signals. The uplink EO modulator (122) includes an optical source (126), such as a high-temperature laser diode, without active cooling.

The downhole electro-optic unit (118) may be operatively connected to a downhole electrical tool bus (not shown). The downhole electrical tool bus provides electrical communication link between the downhole optical telemetry cartridge (116) and one or more downhole tools (depicted generally as downhole data acquisition system 130). The downhole tools may each have one or more sensors for measuring certain parameters in a wellbore, and a transceiver for sending and receiving data.

The downhole optical telemetry system of FIG. 1(A) may be a hybrid optical-electrical apparatus that may use standard-electrical telemetry and sensor technology downhole with the advantage of the high bandwidth fiber optic interface (114) between the downhole components (optical telemetry cartridge, downhole tools) and the surface data acquisition unit. Communications and data transfer between the surface data acquisition unit and one of the downhole tools (depicted as downhole data acquisition system 130) is described below.

An electronic Down Command from the data acquisition unit (102) is sent electrically to the surface telemetry unit (104). The downlink EO modulator (110) of the surface telemetry unit (104) modulates the electronic Down Command into an optical signal, which is transmitted via the fiber optic interface (114) to the downhole optical telemetry cartridge (116). Types of fiber optic interface (114) include wireline cables comprising a single optical fiber or multiple optical fibers. The downlink OE demodulator (120) demodulates the optical signal back into an electronic signal, and the downhole optical telemetry cartridge (116) transmits the demodulated electronic signal along the downhole electrical tool bus (not shown) where it is received by the downhole tool(s).

Similarly, Uplink Data from the downhole tool(s) is transmitted uphole via the downhole electrical tool bus (not shown) to the downhole optical telemetry cartridge (116), where it is modulated by the uplink EO modulator (122) into an optical signal and is transmitted uphole via the fiber optic interface (114) to the surface telemetry unit (104). Sensors of the downhole tools may provide analog signals. Therefore, according to some aspects of the present disclosure, an analog-to-digital converter may be included with each downhole tool or anywhere between the downhole tools and the uplink and downlink modulators/demodulators, as desirable or necessary. Consequently, analog signals from sensors are converted into digital signals, and the digital signals are modulated by the uplink EO modulator (122) to the surface. According to some embodiments, the downhole optical source (126) is input via the optical fiber (114), modulated by the EO modulator (122), and output via the same optical fiber (114) back to the surface optical telemetry unit (104). The uplink OE demodulator (106) demodulates the signal back into an electronic signal which is thereafter communicated to the data acquisition unit (102). Both uplink and downlink signals are preferably transmitted full-duplex using wavelength division multiplexing (WDM).

FIG. 1(A) shows an optical telemetry system utilizing direct modulation with a high-temperature laser diode light source (126) to transport data from downhole to surface. Uplink data (from a downhole tool bus connected to one or more downhole tools) is input into the uplink EO modulator (122), and then directly modulated using the laser diode (126). Output optical light from the laser diode (126) carries a modulated signal, which is transmitted through, for example, a single mode optical fiber (having a length of, for example, more than 10 km) and received by the surface photodiode (108). The surface photodiode (108) inputs signals to the uplink OE demodulator (106) to convert optical data to electrical signals. The data is received by the surface data acquisition system (102).

The high-temperature downhole laser diode of the FIG. 1(A) system simplifies the downhole electronics circuit design, reduces power consumption, provides a simpler power management scheme, and improves tool reliability.

In another possible embodiment of the high-temperature downhole optical telemetry system of FIG. 1(A), a high-temperature laser diode is utilized for an optical telemetry system as a downhole continuous wave (CW) and constant (or non-modulated) light source for an electrical-to-optical (EO) modulator. The EO modulator converts a modulated electrical signal into a modulated optical signal, and transmits the signal to the surface through an optical fiber, for example, a length of single mode optic fiber. The EO modulator provides high data speed (above 1 Gbps) in comparison with the direct modulation high-temperature laser diode (126) depicted in FIG. 1(A).

Figure 1B:
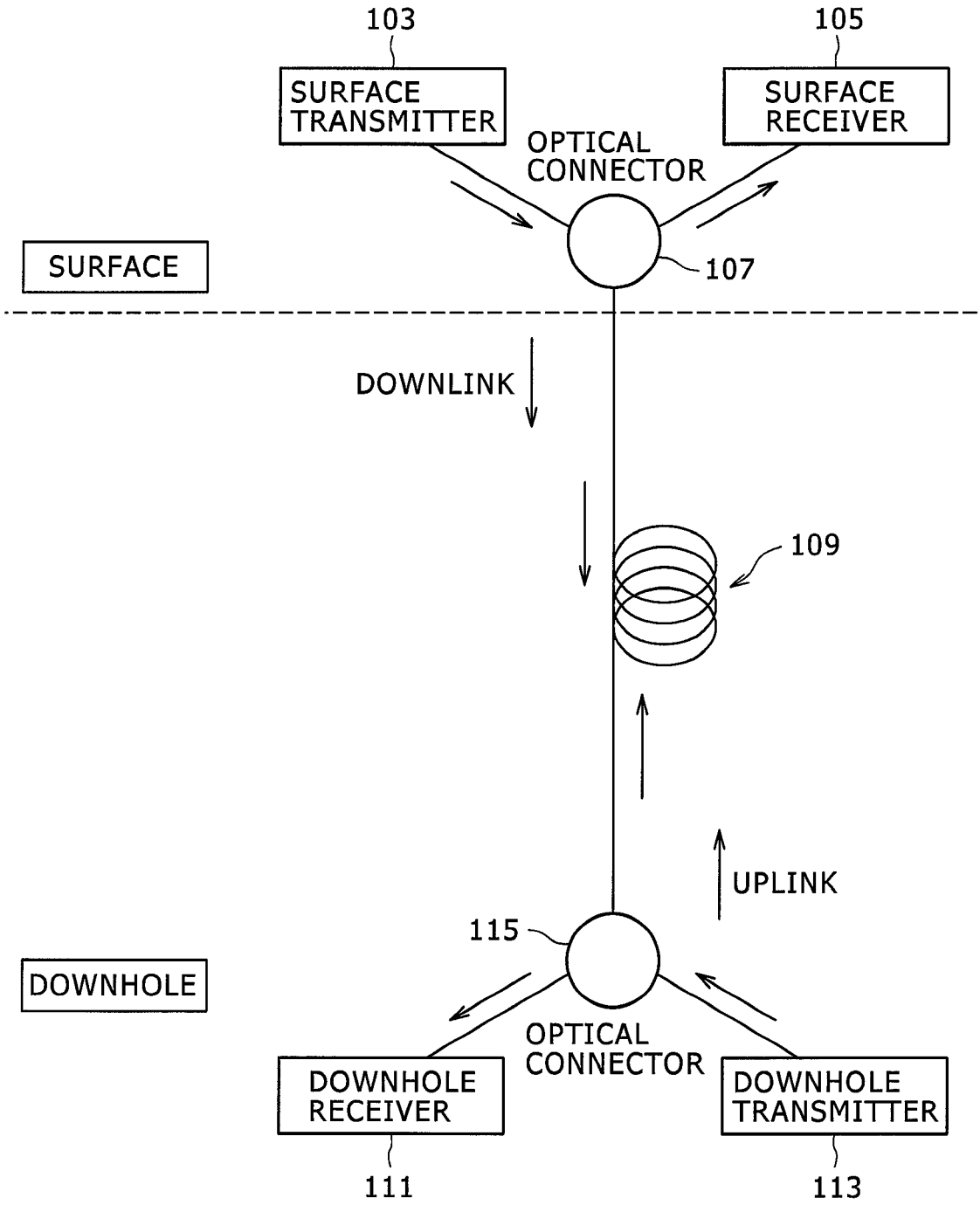
FIG. 1(B) is a schematic depiction of another possible system with a downhole transmitter according to another embodiment of the present disclosure.

FIG. 1(B) is a schematic depiction of a downhole system with an optical telemetry system according to another embodiment of the present disclosure. The optical telemetry system of FIG. 1(B) includes a transmitter (113) and a receiver (111) pair located downhole in a subterranean high-temperature environment and optically connected through a single multi-mode optic fiber (109) with a transmitter (103) and a receiver (105) pair at the surface. Multi-mode wavelength division multiplexers or optical circulators (107, 115) are provided to optically connect the transmitter/receiver pairs with the multi-mode optic fiber. The FIG. 1(B) system provides a full duplex communication system with a single multi-mode optical fiber cable. In other aspects of the FIG. 1(B) system, the system may be duplicated to add redundancy by providing two multi-mode optic fibers with the associated electronics described above in connection with FIG. 1(A).

Although aspects of the present disclosure mention a multi-mode or a single-mode optic fiber, it is not intended that the disclosed embodiments be so limited. In this, the present disclosure contemplates that one or more of a single-mode and a multi-mode optic fiber cable may be used as desirable or necessary for the purposes described herein.

The present disclosure contemplates utilizing high-temperature laser diodes of the type described herein for purposes of the downhole transmitter(s) of the FIG. 1(B) optical telemetry system.

Figure 2A:
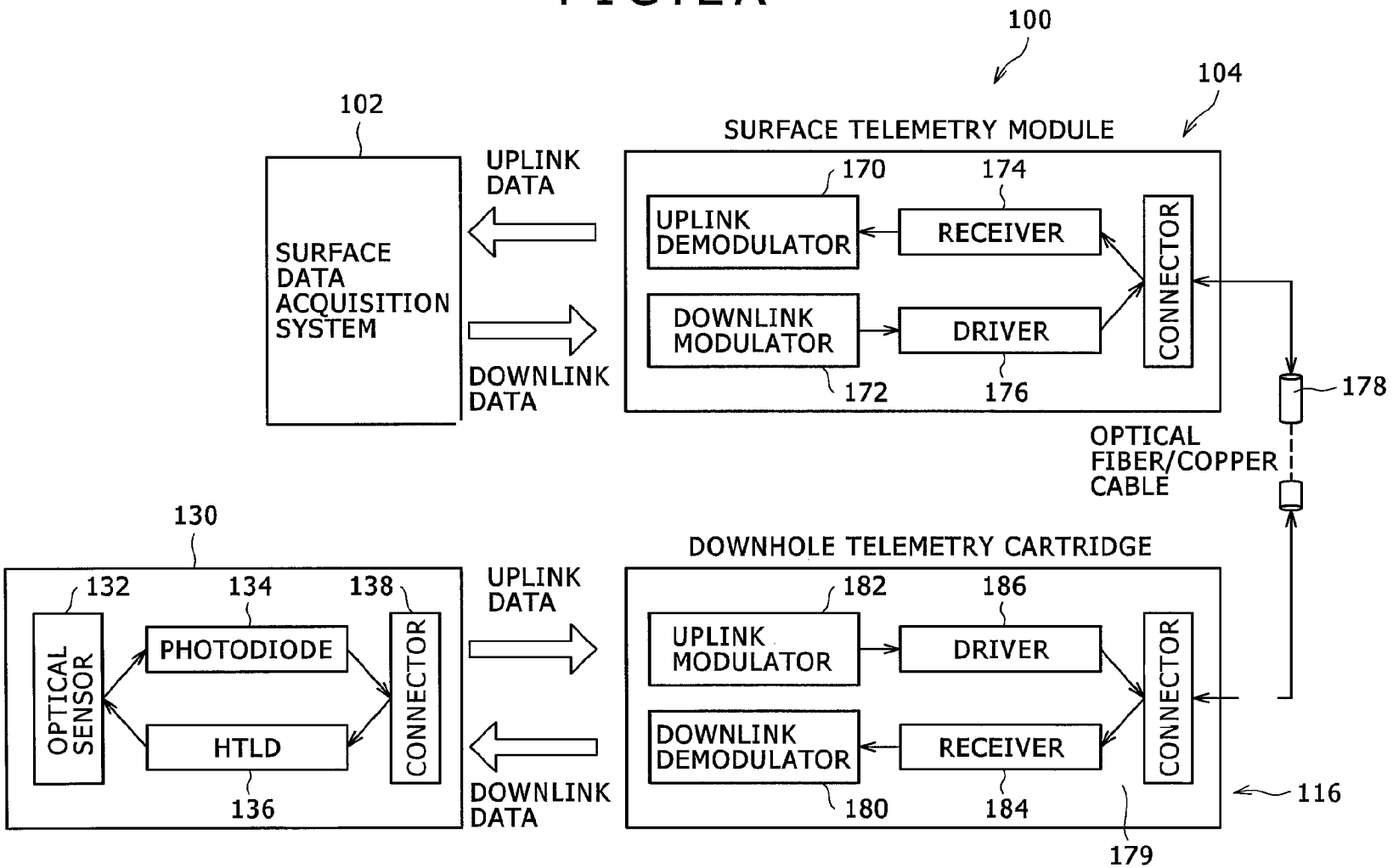
FIG. 2(A) is a schematic depiction of one system with a downhole optical sensor cartridge according to yet another embodiment of the present disclosure.

FIG. 2(A) is a schematic depiction of a high-temperature downhole system with an optical sensor system according to one embodiment of the present disclosure. In the simplified representation of FIG. 2(A), a downhole optical sensing system (130) comprises an optical sensor (132) and a downhole telemetry cartridge (116) coupled to one another. A fiber optic cable or copper cable (178) connects the downhole telemetry cartridge (116) with a surface telemetry module (104), which is coupled to a surface data acquisition system (102). The surface telemetry module (104) includes an uplink demodulator (170), a downlink modulator (172), a receiver (174) coupled to the uplink demodulator (170), and a driver (176) coupled to the downlink modulator (172). The downhole telemetry cartridge (116) includes a downhole unit (179) having a downlink demodulator (180), an uplink modulator (182), a receiver (184) coupled to the downlink demodulator (180), and a driver (186) coupled to the uplink modulator (182). The downhole optical sensing system (130) includes the optical sensor (132), a photodiode (134), a high-temperature laser diode (136), and a controller (138). Sensor (132) may be, for example, a flow sensor, a vibration sensor, such as, acoustic, i.e., seismic, sonic, ultrasonic, accelerometer, sensors, a strain sensor, a spectrometer, pressure/temperature sensor, among others that are known to a person skilled in the art for the purposes described herein.

In the optical sensing system of FIG. 2(A), optical power is supplied by a high-temperature downhole laser diode. The optical power of the laser diode (136) is used to, for example, excite quartz crystal pressure and/or temperature sensors (132) into oscillation, and their resonant frequencies are detected by light modulation or motion detection techniques. Periodic optical pulses representative of the crystal resonant frequencies are then transmitted, via optical fiber (178), to the receiver/demodulator (174/170) in the surface telemetry module (104). A high-temperature laser diode may be used as a downhole light source to send sensor output to the surface system. It is desirable that the power consumption of the downhole light source be small since the available downhole power is limited. In this, VCSEL type laser diodes have low power consumption and are suitable light sources for applications of the type described herein. The sensing system depicted in FIG. 2(A) may be generalized to sensor systems of any type.

Figure 2B:
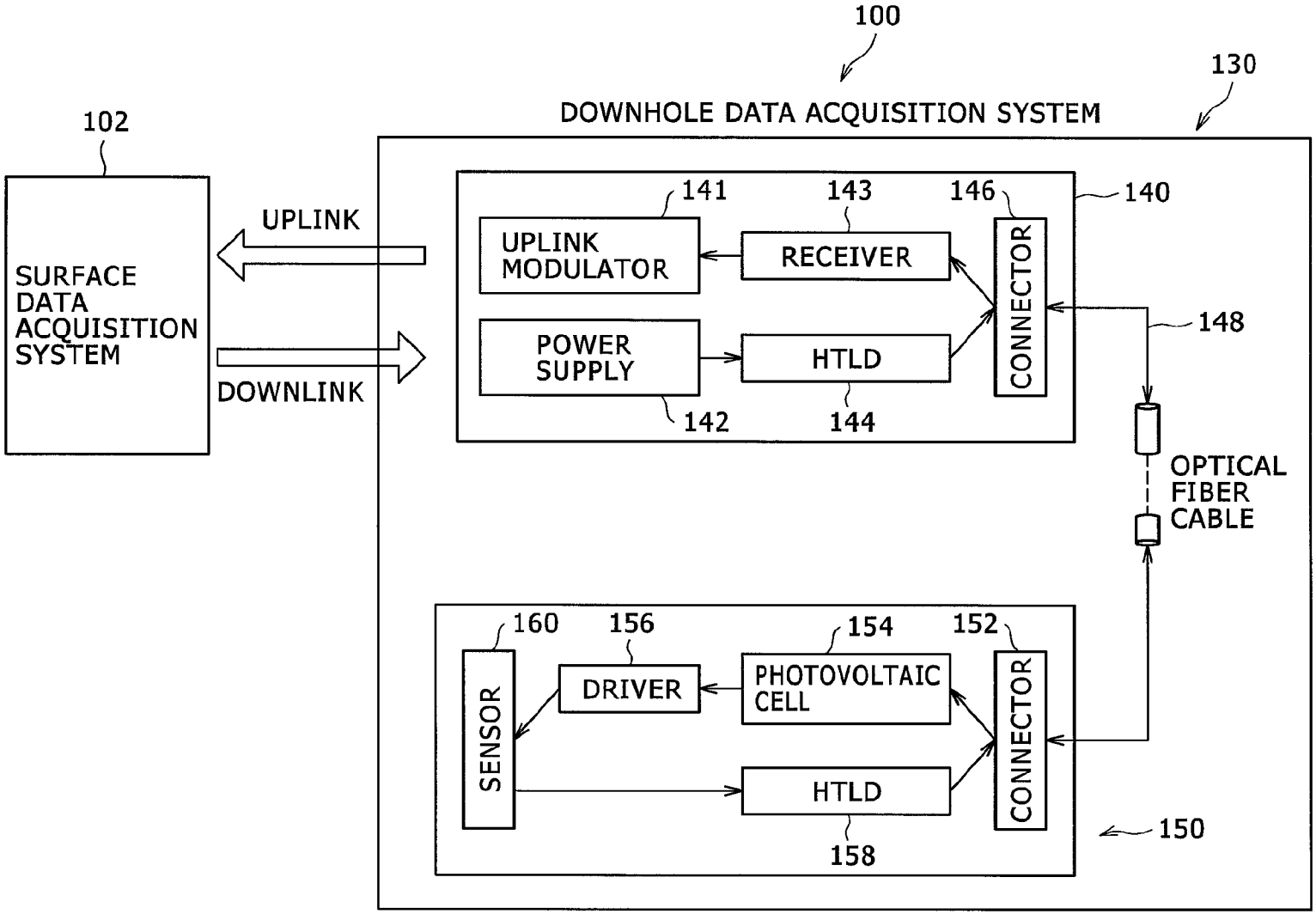
FIG. 2(B) is a schematic depiction of one system with a downhole optical power source according to one embodiment of the present disclosure.

FIG. 2(B) is a schematic depiction of a high-temperature downhole system with a sensor system having a downhole power source according to one embodiment of the present disclosure. In FIG. 2(B), a downhole sensing system (130) comprises a sensor unit (150) and a downhole telemetry/power cartridge (140) coupled to one another. A fiber optic cable (148) connects the sensor module (150) with the downhole/power telemetry cartridge (140), which is coupled to a surface data acquisition system (102). The downhole telemetry/power cartridge (140) includes an uplink modulator (141), a receiver (143) coupled to the uplink modulator (141), and a power supply unit (142) coupled to a high-temperature laser diode (144). The downhole sensor unit (150) includes a sensor (160), a photovoltaic cell (154), coupled to the sensor (160) through a driver (156), a high-temperature laser diode (158), and a controller (152). Sensor (160) may be, for example, a pressure sensor having a pressure port (not shown) at which the sensor (160) receives a fluid (e.g., formation fluids) whose pressure is to be measured. Within sensor (160), the pressure of the fluid is sensed by a pressure transducer (not shown). The sensor (160) receives power from the photovoltaic cell (154), via the driver (156), and produces an electronic output signal to the high-temperature laser diode (158) that has some characteristic, such as frequency, that encodes the measured pressure.

The high-temperature laser diode (144) is located in a safe zone and input light is transmitted via optical fiber (148) to remote sensor(s) (160) in a hazardous or electrically noisy area.

In one embodiment, a single fiber may convey power downhole to remote electronic devices using a surface or downhole high power laser (e.g. a continuous (CW) laser). Note FIG. 2(B). The CW light is conveyed over a length of optical fiber to a downhole system where it is received by an opto-electrical converter, such as a photovoltaic cell. The opto-electrical converter converts the CW light into a voltage used to power downhole electronics, data converters connected to downhole sensors, and/or sensors themselves. In some embodiments, the downhole power may be used to modulate the high-temperature downhole optical source of a different wavelength to transmit digital data from downhole sensors, electronics, and/or data converters uphole along the same optical fiber used to power downhole devices. An optical coupler or optical circulator and an add/drop multiplexer such as a WDM (wavelength division multiplexed) splitter may be used so that modulated optical signal relaying downhole data is conveyed without interference from an upstream laser. Resultant optical signals (representing downhole data) may be received by an uphole photodiode sensitive to the downhole optical source wavelength and converted to an electrical digital signal. Note FIG. 1(A). The electrical digital signal may then be stored or used to monitor downhole conditions.

According to principles described herein, downhole devices including, but not limited to, acoustic, pressure, and temperature sensors, optical components requiring power such as optical switches, Bragg gratings, chemical, fluid phase, fluorescence sensors and detectors, imaging devices, video cameras, low power sensors, such as micro-sapphire gauges, associated electronics for conditioning signals received by the sensors, actuators and controls, MEMS devices or MEMS sensors, and/or integrated conditioning, support, and data conversion electronics may be powered by a high-temperature downhole laser diode light source. In some cases, power provided by a downhole high-temperature optical source may not be sufficient to power sensors or support electronics, and therefore the power converted by the opto-electrical converter may be used to trickle charge or augment power supplied by downhole battery packs.

FIGS. 3(A) to 3(E) depict schematically various exemplary high-temperature downhole sensing systems according to the principles described herein utilizing high-temperature laser diodes for purposes of sensing and/or imaging formation fluids downhole, within a borehole.

Figure 3A:
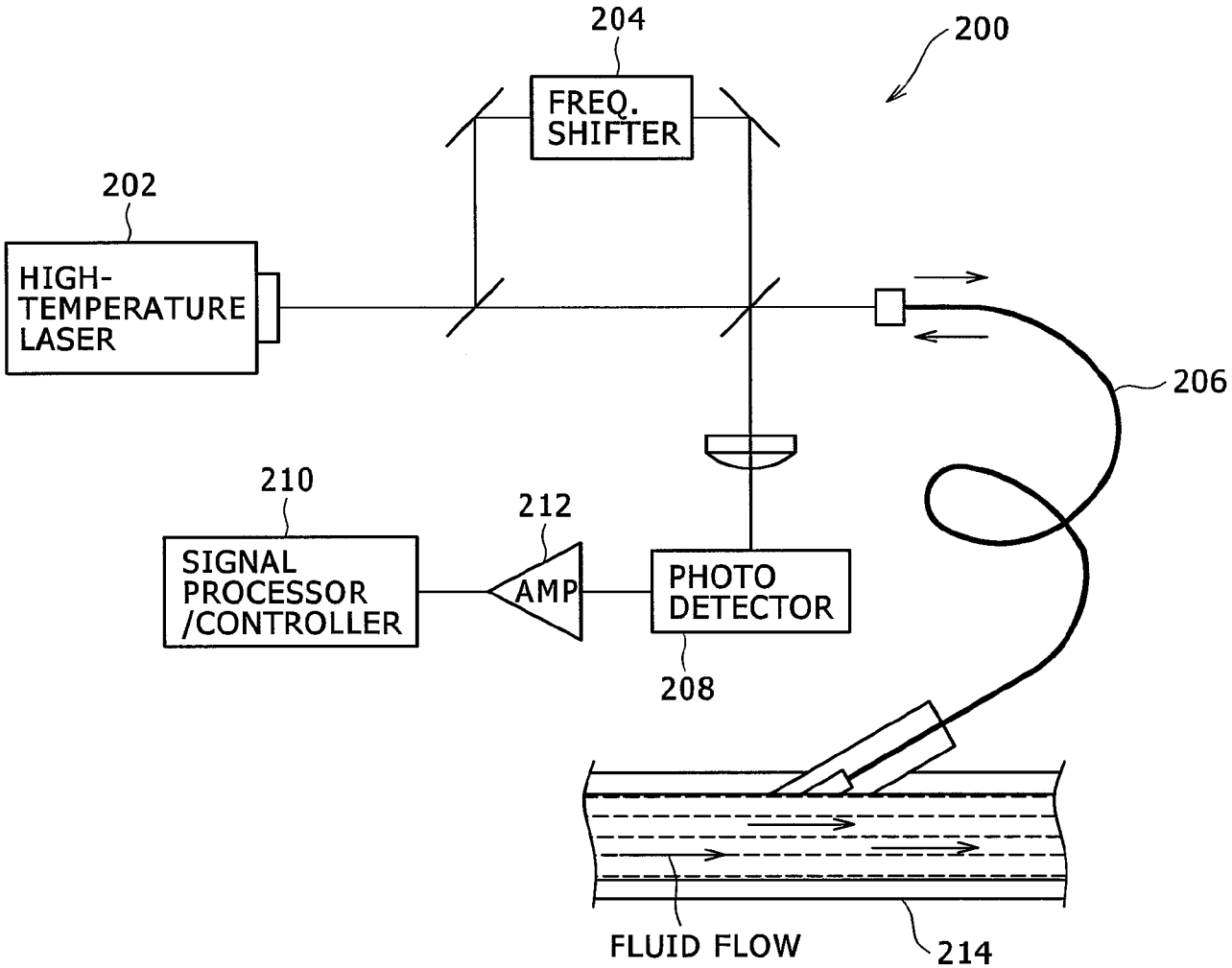
FIG. 3(A) is a schematic depiction of one possible downhole sensing system with a flowmeter according to one embodiment of the present disclosure.

In FIG. 3(A), a high-temperature downhole sensing system includes a flowmeter (200) according to one embodiment of the present disclosure. The flowmeter of FIG. 3(A) includes downhole electronics such as frequency shifter (204), photo detector (208), signal amplifier (212), and signal processor/controller (210). The flowmeter (200) operates utilizing a laser Doppler principle wherein the velocity of flow of a fluid, i.e., formation fluids, in a flowline (214) is measured utilizing the Doppler effect in the light that is scattered by particles contained in the fluid. Light from a high-temperature laser (202) is injected into the flowline (214) by, for example, a collimator (205) attached to an optical fiber (206). The injected light is scattered by the particles in the fluid in the flowline. Some of the scattered light goes back through the collimator/optical fiber (205/206). As particles in the fluid move with the flow of the fluid, the scattered light has a frequency shift due to the Doppler effect, and the fluid velocity can be derived from the amount of the frequency shift.

Figure 3B:
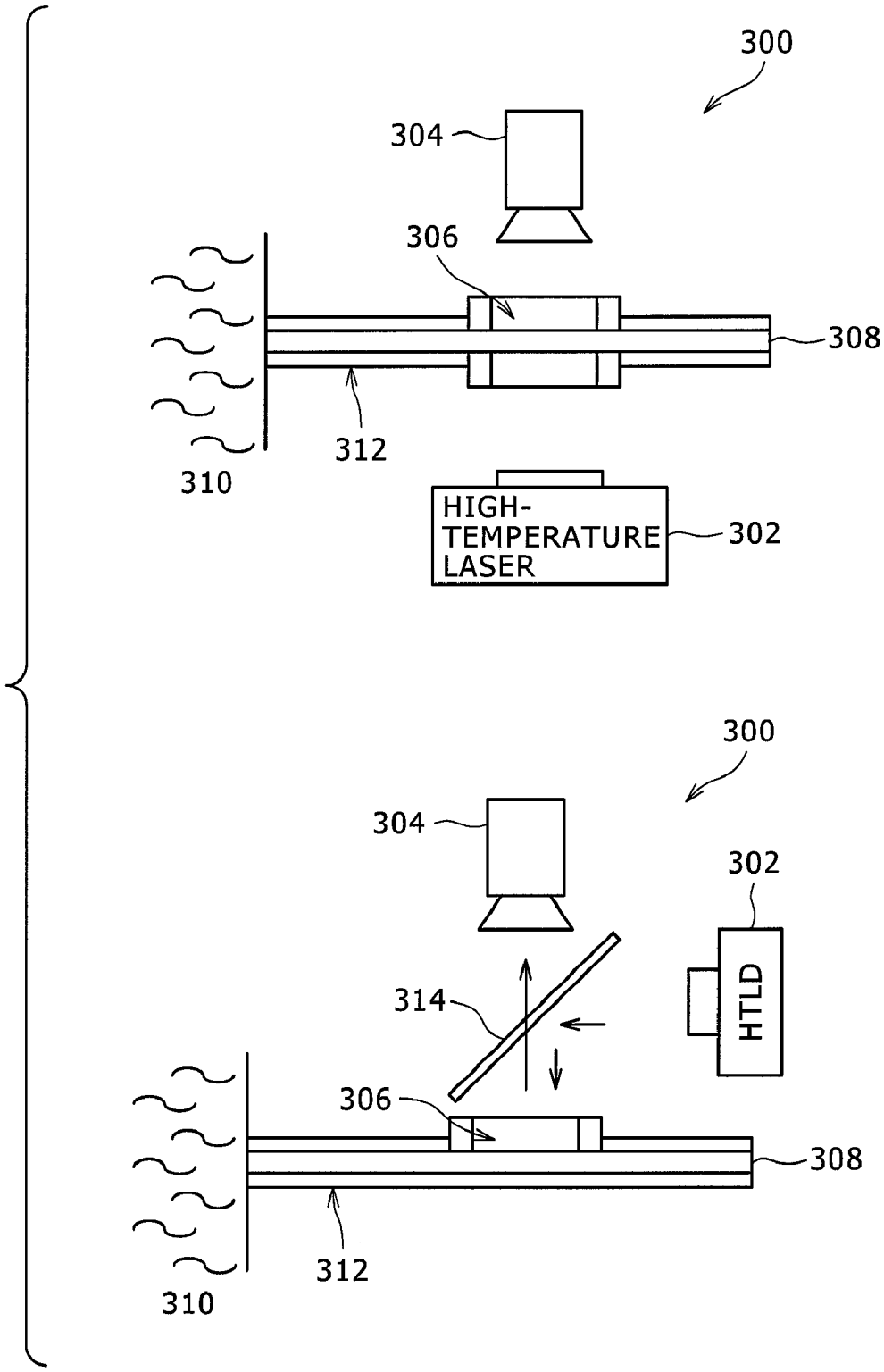
FIG. 3(B) is a schematic depiction of another downhole sensing system with an imager according to one embodiment of the present disclosure.

FIG. 3(B) is a schematic depiction of a high-temperature downhole sensing system with an imager (300) according to one embodiment of the present disclosure. The imager (300) includes, for example, a charge-coupled device (CCD) camera (304), a light source (302), such as a high-temperature laser diode, without active cooling, configured and arranged with respect to a fluid sampling apparatus (312) having a flowline (308) with optical windows (306). Fluids, such as formation fluids from a borehole or formation (310), flow through the flowline (308) and are imaged by the light from the light source (302) and the camera (304). In one embodiment of FIG. 3(B), an arrangement for imaging using transmitted light is provided and, in another embodiment of FIG. 3(B), an arrangement for imaging using back-scattered light is provided.

Co-pending and commonly owned U.S. Patent Publication No. 2007/0035736 provides additional description for downhole spectral imaging, the entire contents of which are hereby incorporated herein by reference.

Utilizing a high-temperature laser diode in the downhole sensing system of FIG. 3(B) provides high optical power output with relatively low power consumption, optical power output by the high-temperature laser diode which, due to its high directivity, is effectively induced in the flowline for imaging with less optical loss, imaging with relatively low optical absorption and low spectral absorption effect due to the focused bandwidth in the 1.2 μm band, and imaging that can be quickly and effectively accomplished. As a consequence, the imaging system of FIG. 3(B) enables faster camera shutter speed to cover higher flow speeds with better picture resolution.

Figure 3C:
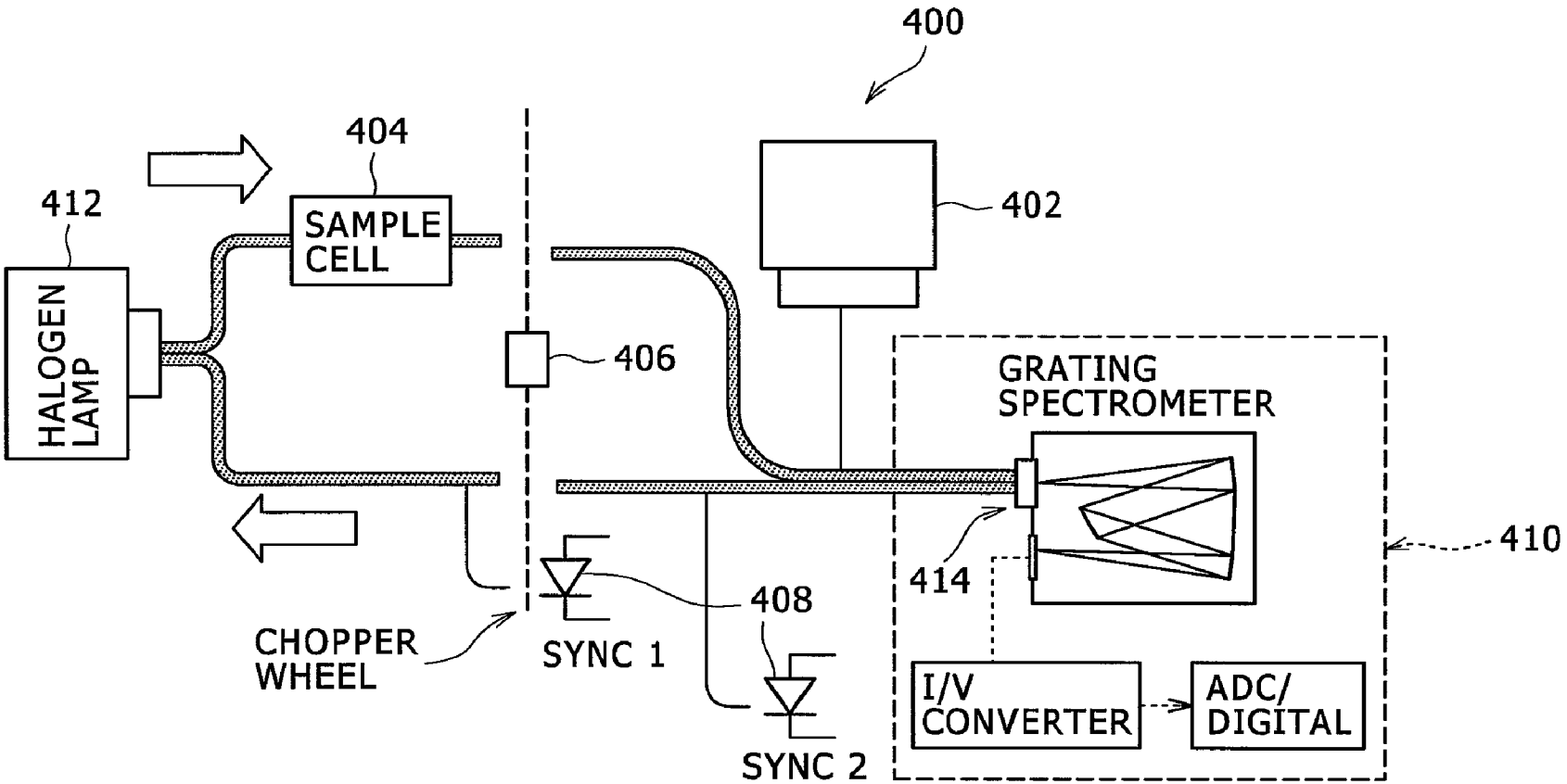
FIG. 3(C) is a schematic depiction of yet another downhole sensing system with a grating spectrometer according to one embodiment of the present disclosure.

FIG. 3(C) is a schematic depiction of a high-temperature downhole sensing system (400) with a grating spectrometer (410) according to one embodiment of the present disclosure. A broadband light source, such as halogen lamp (412), illuminates sample fluid in a sample cell (404). A chopper (406) may be provided to modulate the light which inputs to the grating spectrometer (410) via an optical filter, such as log pass filter (414). Downhole electronics such as photodiodes (408) for signal acquisition synchronization, intensity voltage (I/V) converter, analog to digital converter, and other signal processing electronics, may be provided as desirable or necessary.

A high-temperature laser (402) is provided for wavelength reference. In this, input light from the laser (402) is input via an optical coupler (not shown) to the grating spectrometer (410) to provide a calibration signal to the grating spectrometer (410). With the downhole temperature known, the wavelength (λ) of the laser (402) may be compensated for changes due to temperature, and used for wavelength reference to calibrate the grating spectrometer (410).

Co-pending and commonly owned U.S. Patent Publication No. 2007/0171414 provides additional description for downhole grating spectrometer of the aforementioned type, the entire contents of which are hereby incorporated herein by reference.

Figure 3D:
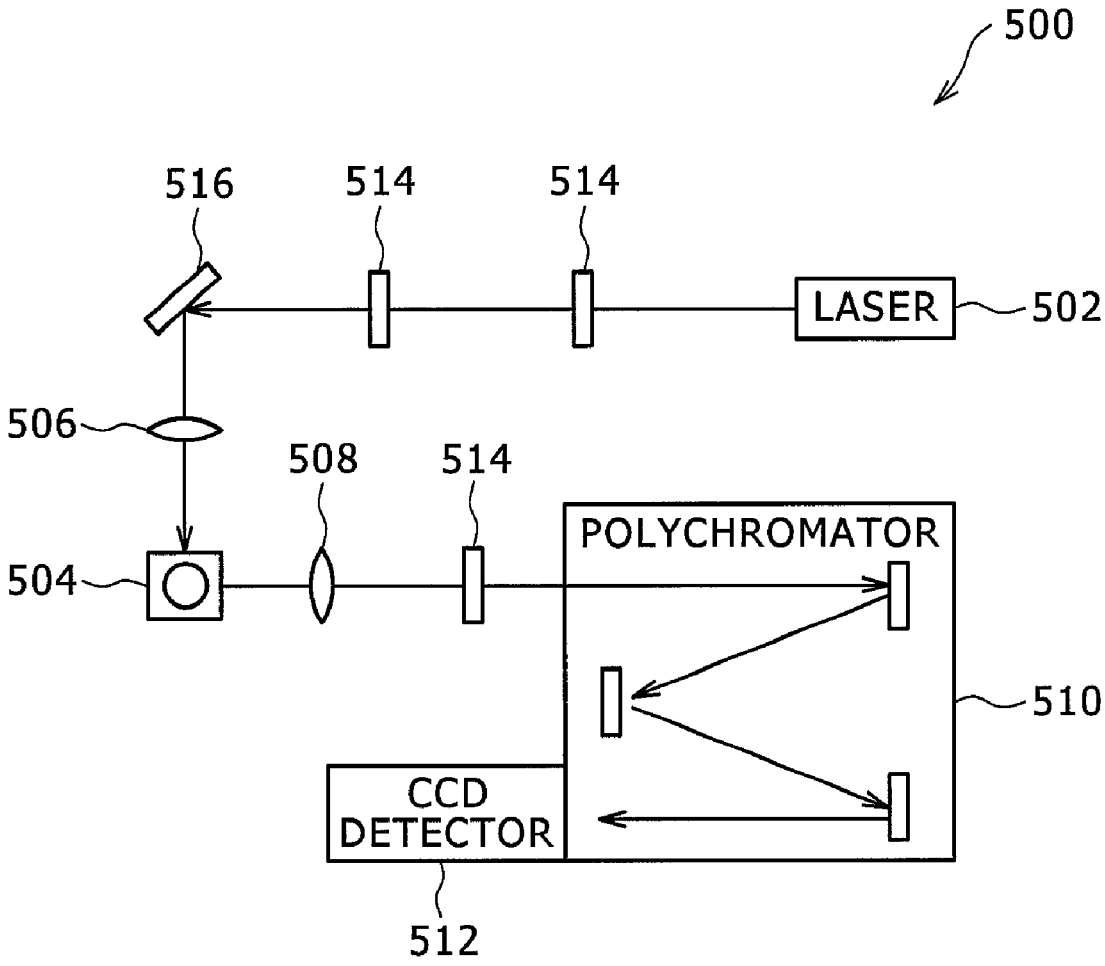
FIG. 3(D) is a schematic depiction of another downhole sensing system with a Raman spectrometer according to one embodiment of the present disclosure.

FIG. 3(D) is a schematic depiction of a high-temperature downhole sensing system (500) with a Raman spectrometer (510) according to one embodiment of the present disclosure. The downhole sensing system (500) of FIG. 3(D) provides a laser Raman spectroscopy system in which a sample (504), such as a sample of formation fluid, is illuminated with monochromatic light from a high-temperature laser (502) of the type disclosed herein. A spectrometer is provided to examine the light scattered by the fluid sample. The laser light passes through various filters (514) and is guided by a suitable lens/mirror (506/508/516) arrangement to a polychromator (510) and a CCD detector (512). The scattering detected by the CCD detector (512) is input to a signal processing/controller (not shown) for processing according to the principles of Raman spectroscopy.

The present disclosure contemplates utilizing a high-temperature laser to provide monochromatic light to illuminate the molecules of a fluid in the sample cell (504) so that Raman scattering occurs as well as Rayleigh scattering. The wavelength of Raman scattering is deviated from the incident light wavelength, and the amount of the wavelength shift, which is termed as Raman shift, depends on the vibration modes of the molecules composing the sample material. Therefore, by detecting the Raman shift utilizing the CCD detector (512) it is possible to characterize the material in the sample cell.

Figure 3E:
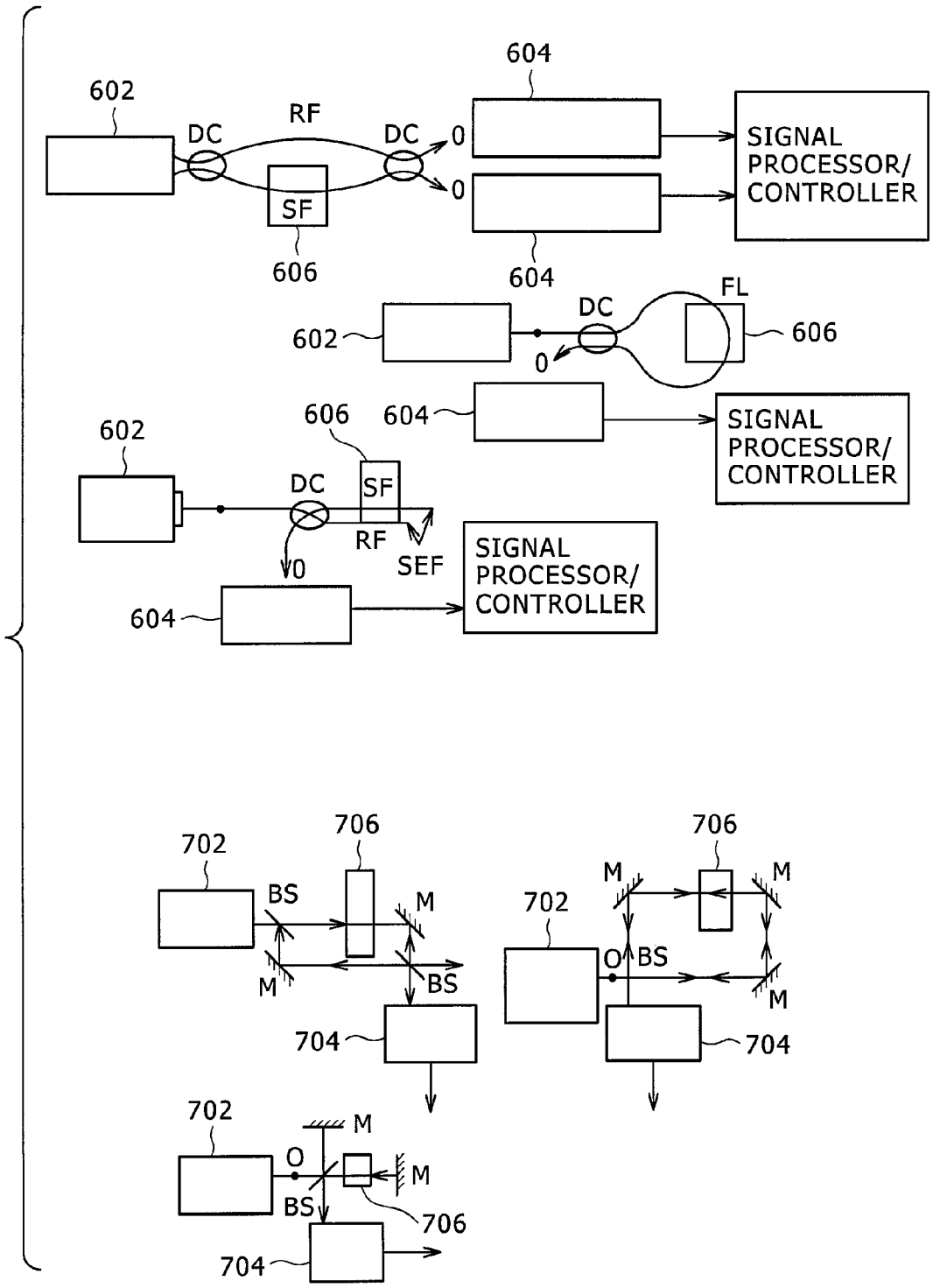
FIG. 3(E) depicts schematically various configurations of downhole interferometric sensing systems with fiber based and bulk interferometers according to some embodiments of the present disclosure.

FIG. 3(E) depicts schematically various configurations of high-temperature downhole sensing systems with fiber based and bulk interferometers according to some embodiments of the present disclosure. One or more high-temperature laser devices (602/702) are provided for inputting light to phase sensitive elements (606/706) and then via photodiodes (604/704) to signal processor/controller for analysis of the signals to derive environmental effects that generate responses from the phase sensitive elements (606/706). Since the principles of interferometric sensors are known to those of skill in the art, they will not be described at length in the present disclosure. In this, environmental parameters such as pressure, flow control, strain, chemical properties and/or temperature may be derived utilizing the interferometric sensors of the aforementioned type.

Commonly owned U.S. Pat. No. 7,292,345 provides description for some interferometric sensors, the entire contents of which are hereby incorporated herein by reference.

Figure 4A:
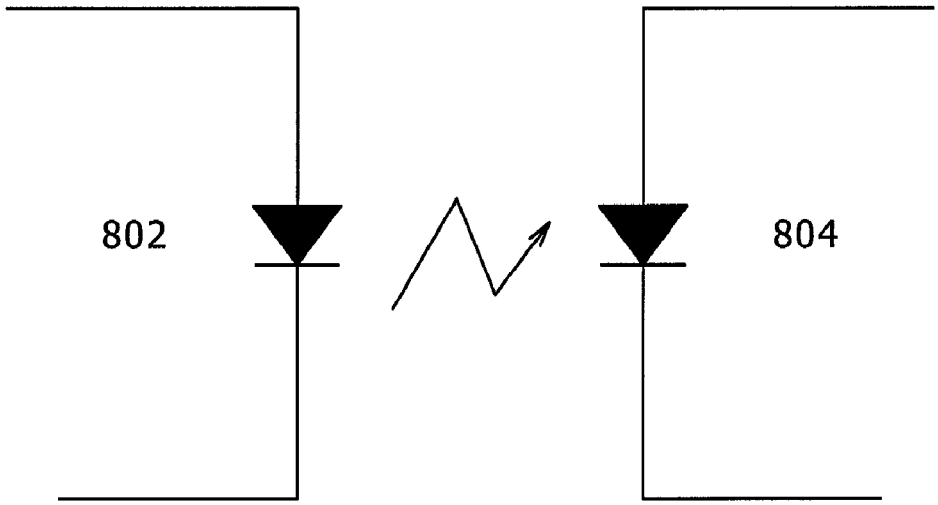
FIG. 4(A) is a schematic representation of an electro-optical isolator circuit (optcoupler) according to one embodiment of the present disclosure.

FIG. 4(A) is a schematic representation of an electro-optical isolator circuit (optcoupler) according to one embodiment of the present disclosure having a high-temperature laser diode (802) optically connected to a photo-sensitive detector (804), and configured or designed for high speed data transmission with ground isolation. The laser diode (802) is arranged to face the photo-sensitive detector (804) and the two elements are inserted in an electrical circuit to form an optcoupler. An insulating gap is provided between the laser diode (802) and the detector (804) such that no current passes through the gap but only the desired light waves representing data. Thus the two sides of the circuit are effectively isolated from one another. The optcoupler of FIG. 4(A) may be utilized for data communication purposes, in particular, in a point-to-point data circuit that covers a distance of several hundred feet or more. In situations where a ground potential difference exists, a phenomenon called ground looping can occur causing current to flow along the data line in an effort to equalize the ground potential between the connected devices. Optical isolation solves the problem of ground looping by effectively lifting the connection between the data line and "ground" at either end of the line.

Figure 4B:
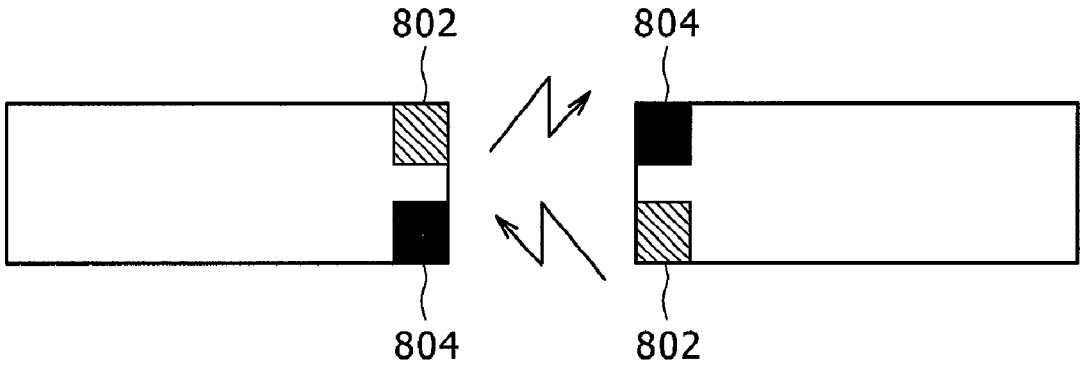
FIG. 4(B) is a schematic representation of an optical connector for peer-to-peer wireless telemetry according to one embodiment of the present disclosure.

FIG. 4(B) is a schematic representation of an optical connector for peer-to-peer wireless telemetry according to one embodiment of the present disclosure having high-temperature laser diodes (802) optically connected to photo-sensitive detectors (804). For example, the configuration of FIG. 4(B) may be utilized for PCB (printed circuit board)-to-PCB data transmission in a downhole tool of the type described herein. In this, the optical circuit of FIG. 4(B) simplifies the downhole architecture by reducing wiring harness for the downhole tool.

Figure 4C:
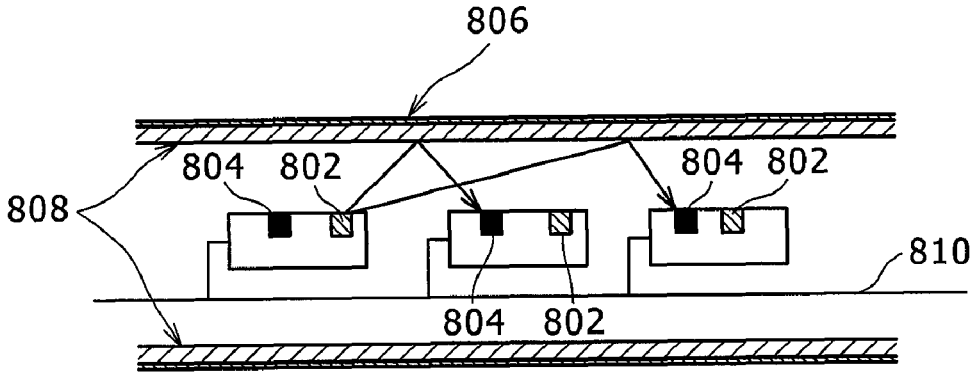
FIG. 4(C) is a schematic representation of an optical connector for network wireless telemetry according to one embodiment of the present disclosure.

FIG. 4(C) is a schematic representation of an optical connector for network wireless telemetry according to one embodiment of the present disclosure having high-temperature laser diodes (802) optically connected to photo-sensitive detectors (804) inside a tool housing (806). A suitable reflection coating (808) on the inner surface of the tool housing (806) and power line harness (810) are provided for PCB-to-PCB wireless data transmission in a downhole tool of the type described herein. In this, the optical circuit of FIG. 4(C) simplifies the downhole architecture by reducing wiring harness for the downhole tool.

Figure 4D:
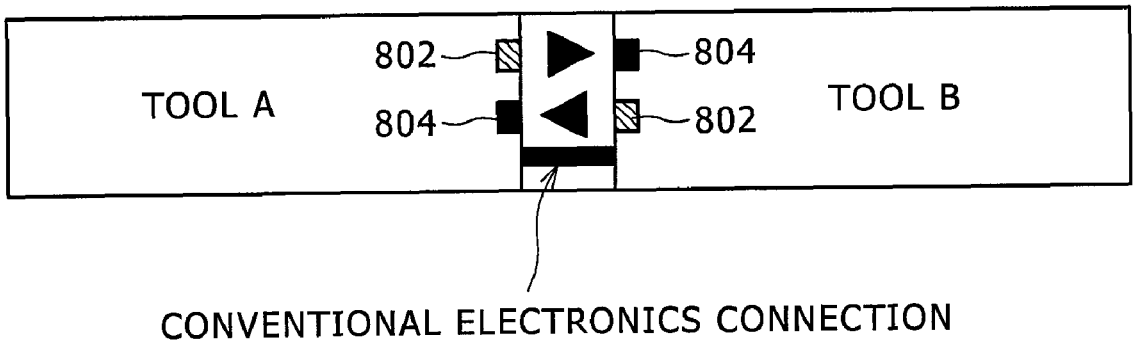
FIG. 4(D) is a schematic representation of an optical connector for tool-to-tool data communication according to one embodiment of the present disclosure.
Figure 4E:
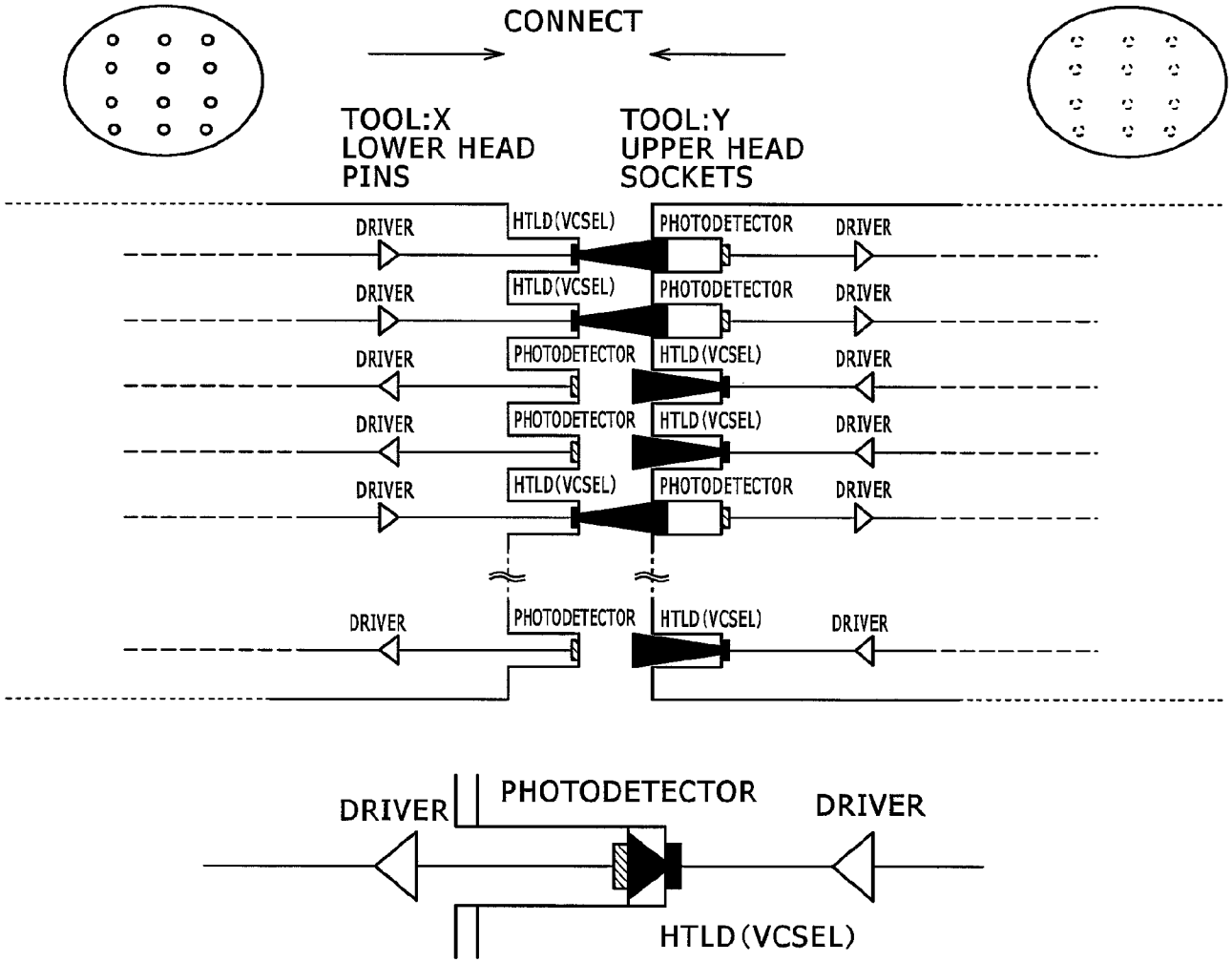
FIG. 4(E) is a schematic representation of another optical connector for tool-to-tool data communication according to one embodiment of the present disclosure.

FIG. 4(D) is a schematic representation of an optical connector for tool-to-tool data communication according to one embodiment of the present disclosure having a high-temperature laser diode (802) and a photo-sensitive detector (804) of a first Tool A optically connected with a corresponding laser diode and photo-sensitive detector pair of a second Tool B. FIG. 4(E) is a schematic representation of another optical connector for tool-to-tool data communication having multiple laser diode-photo-sensitive detector connector pairs in pins and sockets arrangements. The configurations depicted in FIGS. 4(D) and 4(E) provide robust optical coupling with high optical power and large tolerance. In this, the optical connectors of FIGS. 4(D) and 4(E) are suitable for optical communication with high data transmission rates.

Referring to FIGS. 5 to 7, a description is provided with respect to laser diode technology identified by the present inventors as particularly suited for the systems and methods described herein. In this, the inventors have surprisingly found that laser diodes of the type known as highly strained GaInAs—GaAs quantum well laser diodes are suitable for use in high-temperature downhole devices for purposes of optical telemetry and downhole sensing. It has been recognized by the present inventors that a high-temperature edge emitting laser diode (4 mW, CW, If=300 mA) at 1.2 μm utilizing a highly strained GaInAs—GaAs quantum well (QW) structure provides an effective downhole light source. In this, the present inventors have noted that such a structure can maintain high carrier densities in the active layers even under high temperature conditions. A device using the aforementioned laser diode structure has been demonstrated to operate up to 180 degrees centigrade, without active cooling.

Figure 5A:
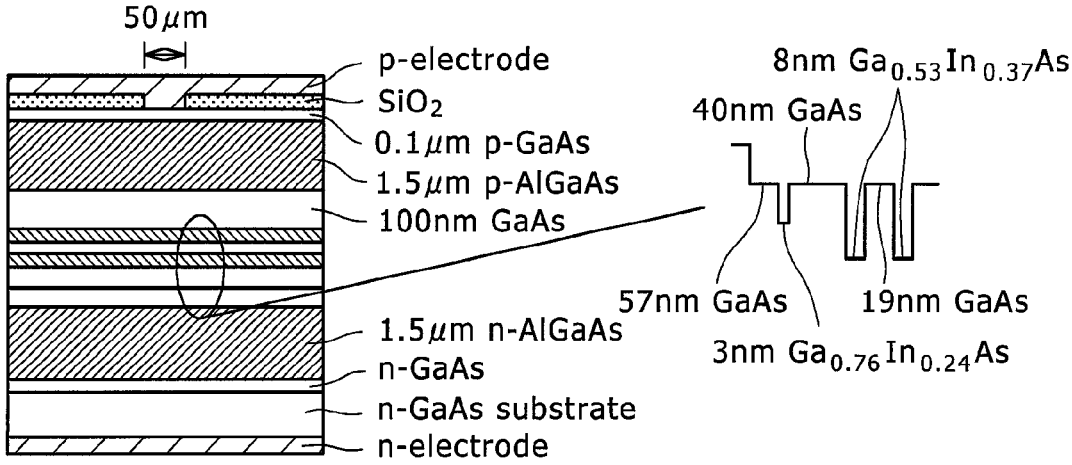
FIG. 5(A) is a schematic representation of a Fabry-Perot edge emitting type laser diode having highly strained GaInAs—GaAs quantum well structure.
Figure 5B:
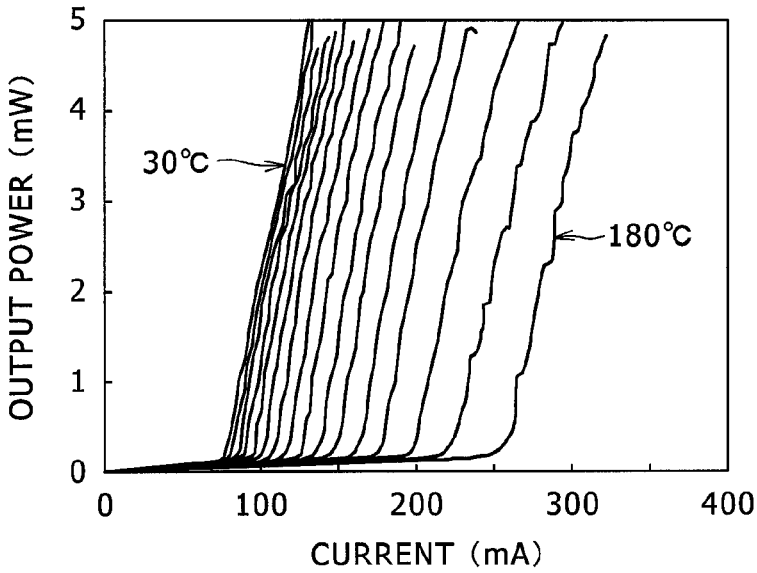
FIG. 5(B) is a graphical depiction of the temperature characteristics of a Fabry-Perot edge emitting type laser diode.

FIG. 5(A) is a schematic representation of a Fabry-Perot edge emitting type laser diode having highly strained GaInAs—GaAs quantum well structure. FIG. 5(B) is a graphical depiction of the power-current characteristics of a Fabry-Perot edge emitting type laser diode up to 180 degrees centigrade.

Figure 6A:
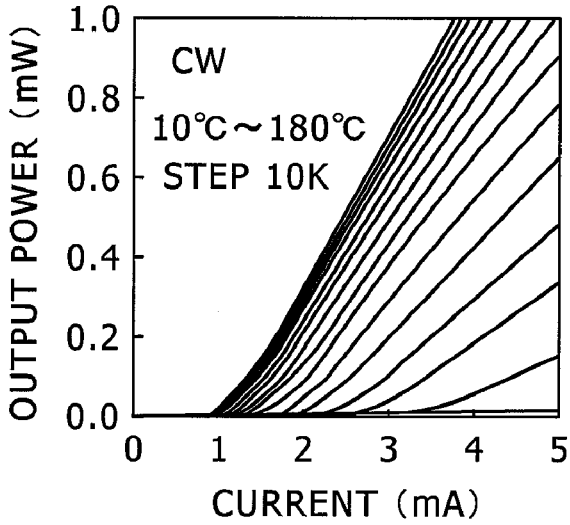
FIG. 6(A) is a graphical depiction of the temperature characteristics of a vertical cavity surface emitting (VCSEL) type laser diode.
Figure 6B:
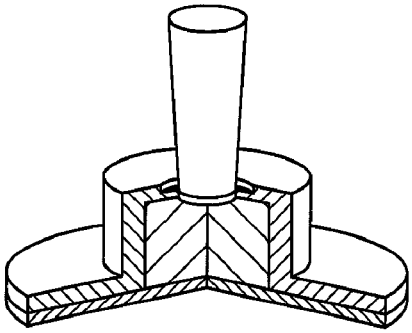
FIG. 6(B) is a schematic representation of the structure of a VCSEL type laser diode.
Figure 6C:
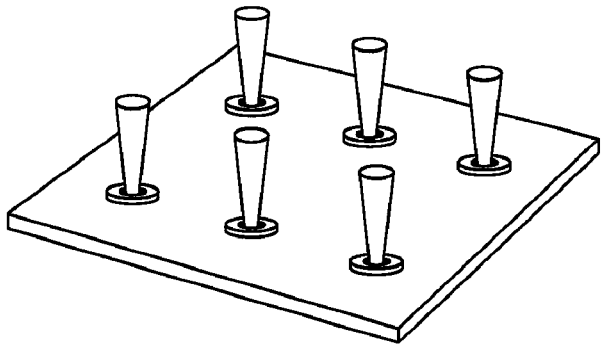
FIG. 6(C) is a schematic representation of a two dimensional VCSEL array.
Figure 7A:
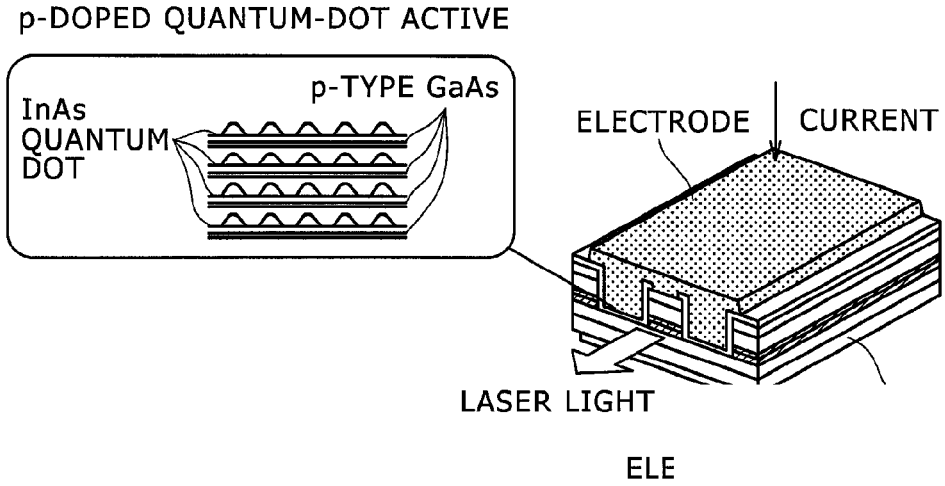
FIG. 7(A) is a schematic depiction of the structure of a quantum dot type laser diode.
Figure 7B:
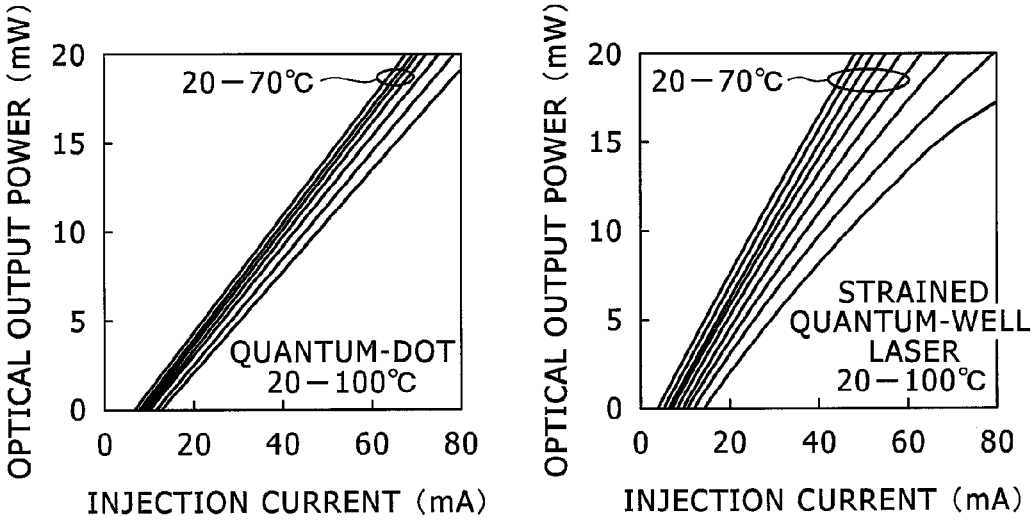
FIG. 7(B) graphically depicts the temperature characteristics of quantum dot and strained quantum well type laser diodes.
Figure 8:
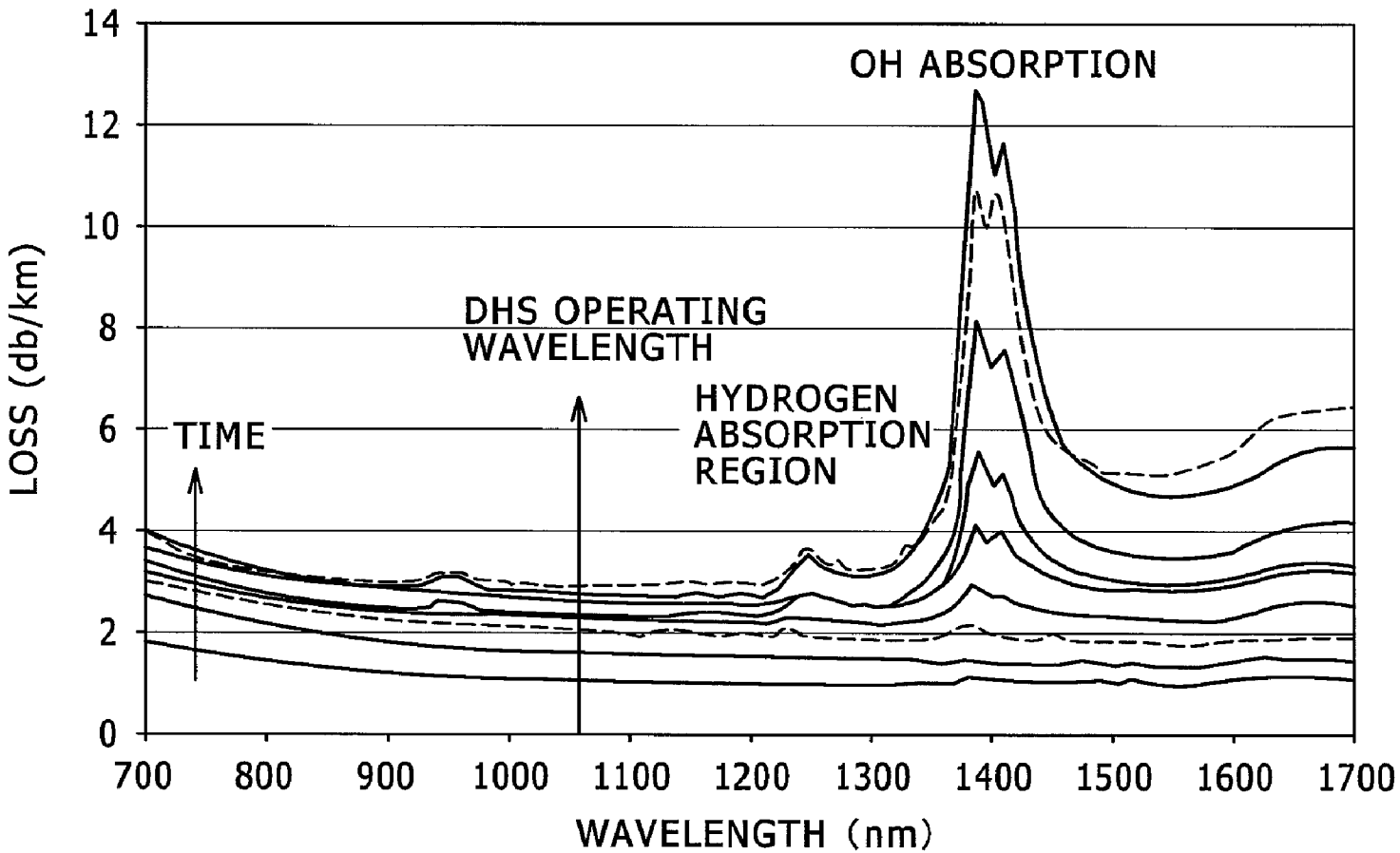
FIG. 8 is a graph showing hydrogen ($H_2$) and —OH absorption into doped silica optical fibers.

Another type of laser diode structure identified for the purposes described herein is a vertical cavity surface emitting laser (VCSEL) having the same or similar structure as the Fabry-Perot edge emitting type laser diode described above. In this, low temperature VCSELs have been developed to operate up to 85 degrees centigrade (1 mW at 40 mA If). FIGS. 6(A) to 6(C) show the structure of a VCSEL type laser diode, a two dimensional VCSEL array, and the temperature characteristics of a VCSEL type laser diode. Since single-mode sources may be preferred for long haul high data rate communication using single-mode fiber, a VCSEL type laser diode has several advantages, such as low threshold trigger power; wafer level inspection; easy fiber coupling; easy construction of high density two dimensional arrays; and low cost. FIG. 6(A) shows in a graph the temperature characteristics of a VCSEL type laser diode up to 180 degrees centigrade. The present inventors further recognized that quantum dot high-temperature laser diodes also might be utilized according to the principles of the present disclosure. FIGS. 7(A) and 7(B) show the structure and temperature characteristics of quantum dot type lasers. In this, a quantum dot laser could minimize temperature sensitive output fluctuations, which previously was not possible with semiconductor lasers. It is noted that newly developed quantum dot lasers could achieve high speed operation of 10 gigabits per second (Gbps) across a temperature range of 20 degrees centigrade to 70 degrees centigrade without electrical current adjustments, and could have minimal output fluctuations caused by temperature changes. The present inventors have recognized that such technology could provide compact, low cost, and low power consumption optical light sources for the purposes of the devices disclosed herein. The aforementioned laser diodes are operable up to 120 degrees centigrade, and possibly 150 degrees centigrade.

Some of the above-described methods and apparatus have applicability for both performing borehole surveys for planning well bore drilling and production and for monitoring borehole data during actual well production. Such borehole surveys include borehole seismic surveys and such monitoring of borehole data includes temporary or permanent monitoring. Fiber optic technology has the ability to multiplex multiple channels at a high data rate, thereby satisfying the demand for acoustic and seismic imaging applications which require a large sensor array with high data transmission capabilities. Use of fiber optic technology in embodiments herein also allows for a greater number of shuttles because of the smaller profile, lighter weight and the fact that no downhole electronics or power from the surface is required.

Sensors used in the borehole environment demand an ever increasing bandwidth as the demand for higher resolution sensors increases. Copper cables used for logging in the borehole are reaching the limit for the bandwidth they can provide. Fiber optic cables can provide a significantly higher bandwidth for new high resolution sensors. The use of fiber optic cables requires high-temperature downhole optical devices, and the electronics used to condition sensor signals and to provide telemetry from downhole to uphole requires electrical power.

As referred to above, fiber optic cables have very efficient transmission capabilities, frequently on the order of several hundred megabytes per second at distances up to 40 km and do not suffer from EMI or transmission loss like copper telemetry systems do. However, optic transmission systems need power to drive the associated electronics required to control the optic data transmission. An optic transmission system associated with a borehole may include a high-temperature downhole laser diode light source that is amplitude modulated by associated electronics. For efficient communications, in some embodiments light sources may be located both uphole and downhole to enable full duplex transmission.

The preceding description has been presented only to illustrate and describe the invention and some examples of its implementation. It is not intended to be exhaustive or to limit the invention to any precise form disclosed. Many modifications and variations are possible in light of the above teaching.

The preferred aspects were chosen and described in order to best explain the principles of the invention and its practical application. The preceding description is intended to enable others skilled in the art to best utilize the invention in various embodiments and aspects and with various modifications as are suited to the particular use contemplated. It is intended that the scope of the invention be defined by the following claims.

What is claimed is:

1. A subterranean tool configured to operate at elevated temperatures, in excess of about 115 degrees centigrade, downhole in a well traversing a formation, comprising:

an optical device configured or designed for downhole use at temperatures in excess of about 115 degrees centigrade; and at least one light source optically connected to the optical device for providing input light to the optical device, wherein the light source comprises one or more laser diodes disposed within the well, the laser diodes being configured to operate in a downhole environment, without active cooling, having temperatures in excess of about 115 degrees centigrade.

2. A subterranean tool according to claim 1, wherein the optical device comprises a downhole optical telemetry cartridge comprising an uplink electrical-to-optical (EO) modulator and the laser diodes downhole, within the well.

3. A subterranean tool according to claim 1, wherein the optical device comprises a downhole transmitter comprising the laser diodes downhole, within the well.

4. A subterranean tool according to claim 1, wherein the optical device comprises a downhole optical sensor cartridge comprising an optical sensor and the laser diodes downhole, within the well.

5. A subterranean tool according to claim 1, wherein the optical device comprises a downhole power cartridge comprising a photovoltaic cell and the laser diodes downhole, within the well.

6. A subterranean tool according to claim 1, wherein the optical device comprises a downhole flowmeter comprising a collimator and the laser diodes downhole, within the well.

7. A subterranean tool according to claim 1, wherein the optical device comprises a downhole imager comprising a camera and the laser diodes downhole, within the well.

8. A subterranean tool according to claim 1, wherein the optical device comprises a downhole spectrometer comprising a grating spectrometer and the laser diodes downhole, within the well.

9. A subterranean tool according to claim 1, wherein the optical device comprises a downhole spectrometer comprising a Raman spectrometer and the laser diodes downhole, within the well.

10. A subterranean tool according to claim 1, wherein the optical device comprises an interferometric optical sensor comprising a sensing element and the laser diodes downhole, within the well.

11. A subterranean tool according to claim 1, wherein the optical device comprises an electro-optical isolator circuit comprising a photo-sensitive detector and the laser diodes downhole, within the well.

12. A subterranean tool according to claim 1, wherein the optical device comprises an optical connector configured or designed for data transmission comprising at least one photo-sensitive detector and the laser diodes downhole, within the well.

13. A subterranean tool according to claim 1, wherein the laser diodes comprises an edge emitting laser diode having GaInAs-GaAs.

14. A subterranean tool according to claim 1, wherein the laser diodes comprises a vertical cavity surface emitting laser diode (VCSEL) having GaInAs—GaAs.

15. A subterranean tool according to claim 1, wherein the laser diodes are configured or designed to operate at wavelengths of about 1.0 to about 1.2 μm.

16. A subterranean tool according to claim 1, further comprising:

an optical fiber optically connected with the optical device, wherein the optical fiber comprises one or more of a single-mode optical fiber and a multi-mode optical fiber, the optical fiber transmitting data to and from downhole electronics and a surface data acquisition system.

17. A downhole telemetry system, comprising:

a surface data acquisition unit comprising a surface telemetry unit;

a downhole optical telemetry cartridge comprising a downhole electro-optic unit;

a fiber optic interface between the surface data acquisition unit and the downhole optical telemetry cartridge;

a downhole tool; and a downhole electrical tool bus operatively connected between the downhole electro-optic unit and the downhole tool, wherein the downhole electro-optic unit comprises:

an electrical-to-optical (EO) modulator; and a laser diode disposed within a borehole, wherein the laser diode is configured to operate in a downhole environment, without active cooling, having temperatures in excess of about 115 degrees centigrade.

18. A fluid analysis system configured to operate downhole at elevated temperatures in excess of about 115 degrees centigrade in a well traversing a formation, comprising:

at least a first light source generating input light downhole across a wide, continuous spectral range; and an optical sensor optically connected to the first light source and operating by the input light generated by the light source to measure signals of interest and determine properties of formation fluids downhole, within the well, wherein the first light source comprises one or more laser diodes disposed within the well, the laser diodes being configured to operate in a downhole environment, without active cooling, having temperatures in excess of about 115 degrees centigrade.

19. A fluid analysis system according to claim 18, wherein the downhole optical sensor is attached to an optical fiber.

20. A fluid analysis system according to claim 19, further comprising:

a second laser diode optically connected to the optical fiber for communicating sensor data uphole.

21. A fluid analysis system according to claim 18, wherein the system comprises multiple sensors, wherein each downhole sensor is optically coupled to at least one of a single-mode and multi-mode fiber optic line.

* * * * *